US006892853B2

(12) United States Patent
Cai et al.

(10) Patent No.: US 6,892,853 B2
(45) Date of Patent: May 17, 2005

(54) HIGH PERFORMANCE MUFFLER

(75) Inventors: Chao Cai, Singapore (SG); Ming Cheng, Singapore (SG); Kin Chew Hung, Singapore (SG)

(73) Assignee: Agency for Science Technology and Research, Singapore (SG)

( * ) Notice: Subject to any disclaimer, the term of this patent is extended or adjusted under 35 U.S.C. 154(b) by 0 days.

(21) Appl. No.: 10/426,558

(22) Filed: May 1, 2003

(65) Prior Publication Data

US 2004/0216951 A1 Nov. 4, 2004

(51) Int. Cl.[7] ..... F01N 1/02; F01N 1/08

(52) U.S. Cl. ..... 181/249; 181/255; 181/269; 181/272

(58) Field of Search ..... 181/249, 255, 181/265, 269, 270, 272, 274, 279

(56) References Cited

U.S. PATENT DOCUMENTS

| | | | | | |
|---|---|---|---|---|---|
| 2,139,739 | A | * | 12/1938 | Durham | 181/274 |
| 3,016,972 | A | * | 1/1962 | Dugas | 181/268 |
| 3,166,152 | A | * | 1/1965 | Conlin | 181/274 |
| 3,703,938 | A | * | 11/1972 | Nelson | 181/274 |
| 3,907,528 | A | * | 9/1975 | Halter | 181/269 |
| 4,011,922 | A | * | 3/1977 | Goplen | 181/272 |
| 4,064,962 | A | | 12/1977 | Hunt | |
| 4,162,904 | A | * | 7/1979 | Clay et al. | 181/274 |
| 4,203,503 | A | * | 5/1980 | Franco et al. | 181/272 |
| 4,253,542 | A | * | 3/1981 | Ruspa et al. | 181/272 |
| 4,905,790 | A | * | 3/1990 | Luszczycki | 181/272 |
| 5,162,620 | A | | 11/1992 | Ross et al. | 181/220 |
| 5,828,013 | A | | 10/1998 | Wagner et al. | 181/255 |
| 5,844,178 | A | * | 12/1998 | Lothringen | 181/269 |
| 6,089,348 | A | | 7/2000 | Bokor | 181/272 |
| 6,220,387 | B1 | | 4/2001 | Hoppes et al. | 181/259 |
| 6,241,044 | B1 | * | 6/2001 | Nishiyama et al. | 181/272 |
| 6,364,054 | B1 | | 4/2002 | Bubulka et al. | 181/264 |
| 6,467,570 | B1 | * | 10/2002 | Herold | 181/231 |

FOREIGN PATENT DOCUMENTS

| | | | | | |
|---|---|---|---|---|---|
| DE | 2835138 | | | 3/1980 | |
| DE | 3108131 | | | 9/1982 | |
| JP | 52025946 | A | * | 2/1977 | F01N/7/18 |
| JP | 57110709 | A | * | 7/1982 | F01N/1/02 |
| JP | 61207814 | A | * | 9/1986 | F01N/1/00 |
| JP | 05288047 | A | * | 11/1993 | F01N/3/24 |
| JP | 2001-123819 | A | | 5/2001 | |
| SU | 1613666 | | | 12/1990 | |
| SU | 1652634 | A | | 5/1991 | |

OTHER PUBLICATIONS

International Search Report dated Jun. 18, 2004.

* cited by examiner

*Primary Examiner*—Edgardo San Martin
(74) *Attorney, Agent, or Firm*—Nixon & Vanderhye P.C.

(57) ABSTRACT

A high performance muffler, e.g., for an internal combustion engine, reduces exhaust or other gas noise while maintaining a low backpressure to prevent engine power loss. A side inlet pipe connects gas to a muffler body. The inlet pipe is flared at its connection to the muffler body to direct flow of the gas through an inlet chamber of the muffler in a spiral path. In an example embodiment, the muffler body includes three chambers separated by panels. An inlet expansion chamber is adjacent to the inlet and includes a first pipe with a perforated portion. An intermediate expansion chamber adjacent to the inlet chamber receives the gas from the first pipe. Four small pipes at the exit end of the intermediate chamber extend into an outlet expansion chamber. The gas in the outlet expansion chamber exits the muffler body by an outlet pipe at the other end of the outlet expansion chamber. The muffler achieves a high sound reduction without increasing backpressure.

32 Claims, 6 Drawing Sheets

Muffler without perforated region and flared opening. Back pressure = 0.3 bar.

Muffler with perforated region but without flared opening. Back pressure = 0.28 bar.

Muffler with perforated region and flared opening. Back pressure = 0.25 bar.

HIGH PERFORMANCE MUFFLER

FIELD OF THE INVENTION

The present invention relates to a muffler that may advantageously he employed with an internal combustion engine or with any other machine that generates acoustic energy during operation. The muffler in accordance with the present invention reduces exhaust noise while maintaining a low backpressure to prevent engine power loss.

BACKGROUND

Exhaust noise is a dominant noise associated with an internal combustion engine. Mufflers control and modify the noise produced by exhaust from internal combustion engines. Better acoustic performance of exhaust and other gas mufflers is important for the automobile and other machine-related industries in order to meet community noise standards. Indeed, new regulations are almost continually being proposed which require ever more stringent noise standards.

Some muffler systems use sound attenuating materials like glass fiber. But due to the debris or waste existing in the exhaust gas from internal combustion engines, such absorption materials are seldom used because of the high maintenance cost. Sound absorbing materials also add to the overall cost and weight of the muffler system, restrict the flow of exhaust, and may encourage heat build-up.

An improvement in the noise reduction performance of a muffler is typically accompanied by an undesirable high backpressure. If the muffler is used with an internal combustion engine, a high backpressure results in power loss, engine inefficiency, and high fuel consumption. Numerous muffler designs attempt to attenuate exhaust and other gas noise but little attention paid to the corresponding increase in backpressure. Backpressure is particularly a concern for reactive mufflers that operate on the principle of reflecting acoustic energy back towards the acoustic source.

Although seemingly contradictory, it is desirable to design a muffler that provides substantial noise attenuation without reliance on sound attenuating materials and that also does not generate an accompanying increase in backpressure.

SUMMARY OF THE INVENTION

A muffler for use in attenuating a sound induced by or associated with a gas produced by a machine includes an elongated body having a first axis along its length and including a first partition for defining an inlet chamber. The body has an inlet opening on a side of the body and an outlet opening at one end of the body. An inlet pipe connects to the side of the body at the inlet opening and delivers the gas into the inlet chamber. The side inlet pipe is oriented at an angle to the first axis greater than zero degrees. In a preferred example embodiment, the inlet pipe is connected to the inlet opening at an angle substantially greater than zero degrees, such as 90 degrees. An outlet pipe connected to the outlet opening discharges muffled gas from the body. In a preferred example embodiment, the one end of the inlet pipe is flared. The side inlet pipe as well as its flared end permit attenuation of the gas sound by the muffler without increasing back pressure associated with that sound attenuation in a direction opposite to that of the gas flowing in the inlet pipe.

A cross-section of the inlet pipe may be square, rectangular, circular, or elliptical. The muffler body may be cylindrically-shaped with a circular cross section or it may have an elliptical cross-section. In a preferred example embodiment, the muffler is a reactive muffler.

A first pipe extends from the inlet chamber through the first partition into a second chamber. The first pipe includes one or more perforations in a first portion of the first pipe in the inlet chamber.

The one or more perforations permit gas in the inlet chamber to flow into the first pipe and into the second chamber. A second partition defines the second chamber as an intermediate chamber and separating the intermediate chamber from an outlet chamber that includes the outlet opening. One or more second pipes extend from the intermediate chamber through the second partition into the outlet chamber. In a preferred example embodiment, a length of the one or more second pipes is less than a length of the first pipe.

In a specific implementation, a high performance reactive exhaust muffler for an internal combustion engine has a high acoustic performance-to-weight ratio and maintains a low backpressure to the engine. The muffler includes a muffler body generally cylindrical in shape. A side inlet pipe is flared at its interface with the muffler body and is preferably perpendicular to a longitudinal axis of the muffler body. The exhaust gas flows through the flared inlet opening into an inlet chamber where it experiences a first expansion. This side inlet pipe design gives a much larger expansion ratio compared to conventional end-in inlet pipe designs, and therefore, has better sound attenuation performance.

A first pipe extends through a first wall that separates the first expansion chamber from a second intermediate expansion chamber in the muffler body. A section of the first pipe in the inlet chamber includes perforations. After the first expansion when the exhaust gas enters the inlet chamber, the exhaust gas undergoes a first contraction flowing to the perforated long pipe.

A second expansion takes place when the exhaust gas enters the intermediate chamber. Four smaller pipes extend through a second wall that separates the second expansion chamber from a third outlet expansion chamber. In the process of flowing through the four pipes to the outlet chamber, the exhaust gas undergoes a second contraction. A third expansion of the exhaust gas takes place in the outlet chamber. Finally, the exhaust gas is discharged from the muffler through an outlet pipe of the muffler connected to the third outlet chamber.

The muffler design is based on knowledge gained through studies and numerical simulations of duct acoustics and flow dynamics. The muffler achieves excellent levels of sound attenuation while appreciably reducing backpressure at least relative to conventional mufflers. The muffler may also be retrofitted to the exhaust system of existing motorized vehicles, e.g., trucks, automobiles, vans, and in general all kinds of motorized vehicles. Indeed, the muffler finds advantageous application to any muffler system including, for example, the internal combustion engines used in factories and ships.

BRIEF DESCRIPTION OF THE DRAWINGS

Further understanding of the present invention may be derived by referring to the detailed description considered in connection with the Figures where like reference numerals refer to like elements throughout.

DETAILED DESCRIPTION

The muffler in accordance with the present invention is referred to as a reactive muffler. The reactive muffler uses an impedance mismatch along the path of sound wave propagation to reflect acoustic wave energy back to its source. As described below, the reactive muffler includes plural acoustic expansion chambers and pipes that function as acoustic resonators. These acoustic resonators correspond to annular sections (chambers) formed by the muffler casing and connecting pipes. Each acoustic resonator modifies the acoustic impedance along the sound transmission path in the muffler at its resonant frequencies. In general, the chamber lengths and pipe lengths are tuned to the major and harmonic frequencies in the appropriate exhaust noise frequency spectrum.

The following description is directed to an example muffler application to an internal combustion engine in which noise associated with exhaust gas from that engine is attenuated by the muffler. However, the present invention is not limited to this particular application and may be used in any environment where it is desirable to attenuate noise (undesired acoustic energy) caused by the discharging of gas of any type of machine.

Figure 1:
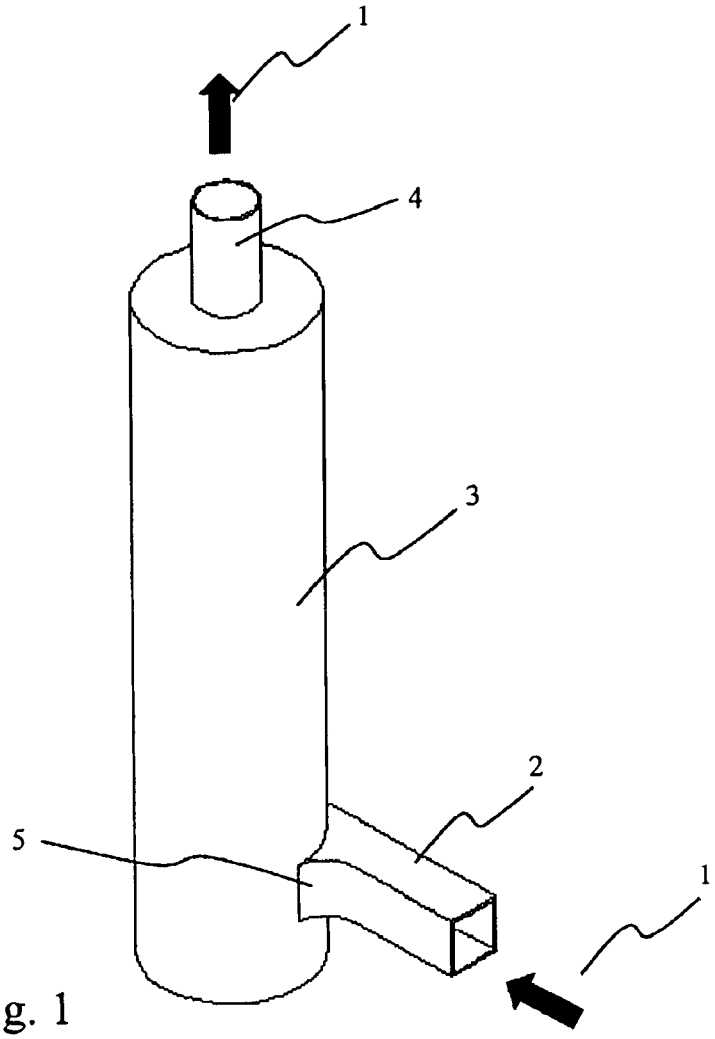
FIG. 1 shows a perspective view of a muffler in accordance with the present invention.
Figure 2:
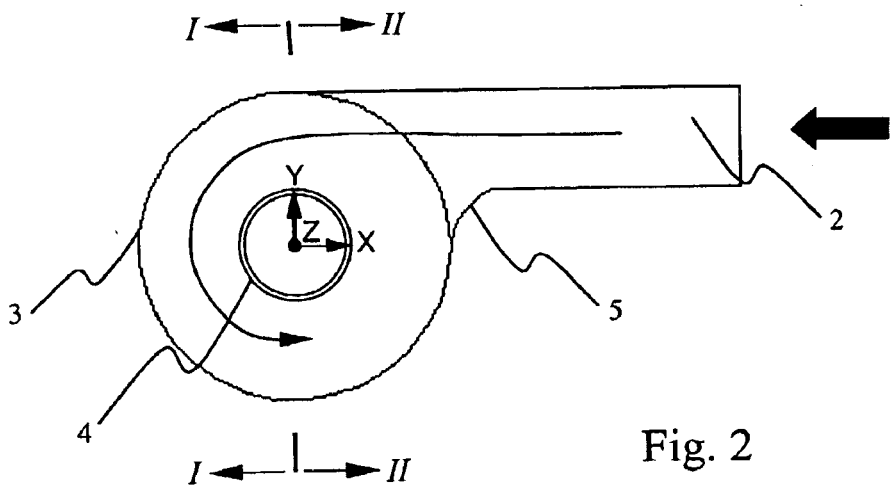
FIG. 2 shows a top view of the muffler of FIG. 1.

FIG. 1 shows a perspective view of an example, non-limiting embodiment of an exhaust muffler in accordance with present invention. The muffler includes muffler body 3, which in this example, is cylindrically-shaped. The muffler could be other shapes, e.g., elliptical cross section rather than circular cross section. A side inlet pipe 2 is connected to a side of the muffler body 3 toward one end. The side inlet pipe 2 is non-parallel to the longitudinal (along the length of) axis of the muffler body 3. While the side inlet pipe 2 can be oriented at any non-zero angle relative to the longitudinal axis, in this example, the side inlet pipe 2 is substantially perpendicular to a longitudinal axis of the muffler body 3. As shown in FIG. 2, the gas from side inlet pipe 2 moves in a spiral-type path when it enters the muffler body 3. The spiral path is advantageous because the flow direction along the path changes gradually and smoothly thereby minimizing local flow energy loss.

The side inlet pipe 2 is preferably flared at the end that interfaces with/connects to the side of the muffler body 3. The flared end decreases back pressure because it reduces the local energy loss caused by the sharp corner present at the connection of the side inlet pipe 2 and the muffler body 3 if a straight pipe were used. This effect is explained further in conjunction with FIGS. 7A–7C. Although the side inlet pipe 2 is shown with a square cross section, its cross section can be any suitable shape including rectangular, circular, or elliptical to name a few.

Exhaust or other gas is received by the side inlet pipe 2 and directed into the muffler body 3 as shown by the black arrow 1. When applied to internal combustion engines, the exhaust gas discharged from the cylinders of the internal combustion engine flows directly into the exhaust muffler or via a catalytic converter of the internal combustion engine. The exhaust gas flows through the muffler body 3 in a flow path that can be seen from FIGS. 2, 3 and 4. The muffled gas exits the muffler body 3 through an outlet pipe 4 also as shown by the black arrow 1.

Figure 3:
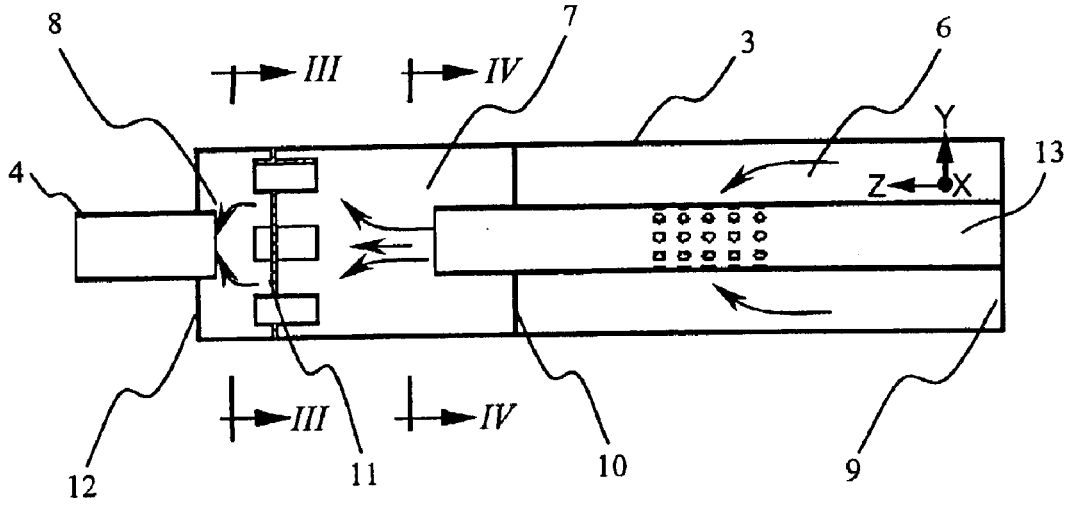
FIG. 3 shows a section A—A view of the muffler of FIG. 2.
Figure 4:
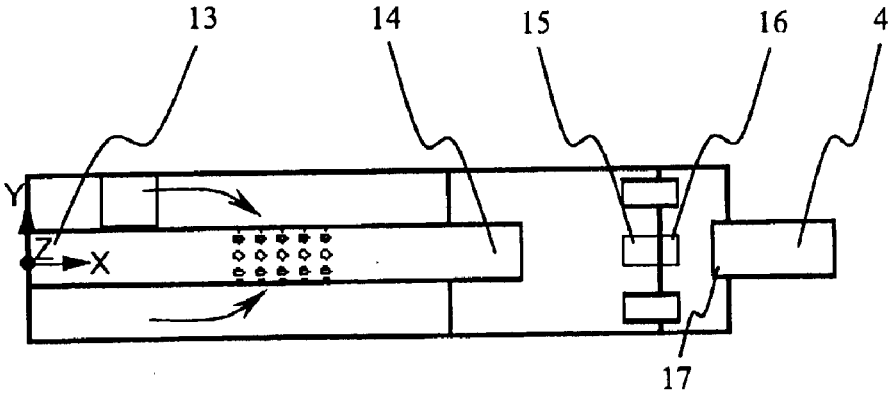
FIG. 4 shows a section B—B view of the muffler of FIG. 2.
Figure 5:
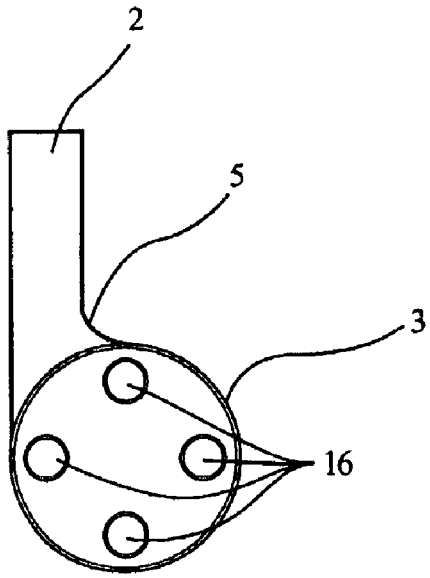
FIG. 5 shows a section C—C view of the muffler of FIG. 3.
Figure 6:
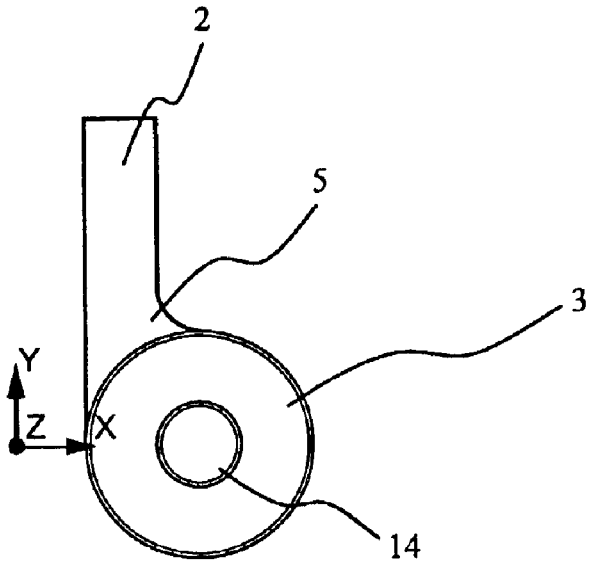
FIG. 6 shows a section D—D view of the muffler of FIG. 3.

As shown in FIG. 3, the muffler body 3 in this non-limiting example is divided into three expansion chambers by panels 10 and 11. The three expansion chambers include an inlet chamber 6, an intermediate chamber 7, and an outlet chamber 8. The inlet chamber 6 receives exhaust gas from the side inlet pipe 2 and allows the exhaust gas to expand. The length of the inlet chamber 6 is longer than the lengths of the intermediate chamber 7 and the outlet chamber 8. Its length is determined based on the actual exhaust noise spectrum. For example, the length of the inlet chamber can be set to be C/f, where C is the speed of the sound wave inside the chamber, and f is one of the dominant peak frequencies in the spectrum whose noise level is to be suppressed. The lengths of the other chambers and the inserted pipes in the muffler are determined based on the selected length of the inlet chamber 6.

A first chamber pipe 13 extends through the chamber panel or wall 10 between the inlet chamber 6 and the intermediate chamber 7 along the longitudinal centerline of the cylindrical body 3. The length of the intermediate chamber 7 is preferably half of the length of the inlet chamber 6. The cross section in FIG. 2 shows how the exhaust gas enters the side inlet pipe 2 and circulates around the first chamber pipe 13 in a spiral path. Although only one first chamber pipe is shown, more than one chamber pipe may be used.

A portion of the first chamber pipe 13 in the first expansion chamber 6 is perforated. The axial length of the perforated region in the first chamber pipe 13 is preferably one quarter of the length of the inlet chamber. The left end of the perforated region in FIG. 3 is preferably one quarter of the length of the inlet chamber away from the panel 10. The first chamber pipe 13 penetrates the panel 10 and extends into the intermediate chamber 7 preferably about half of the length of the intermediate chamber 7. The exhaust gas in the inlet chamber 6 flows into the first chamber pipe 13 through the perforations. The reduced sectional area of the first chamber pipe 13 compresses the volume of the exhaust gas flowing in that inlet chamber 6. The intermediate chamber 7 receives the compressed exhaust gas from the first chamber pipe 13, and the exhaust gas expands a second time when entering the intermediate chamber 7.

The second intermediate expansion chamber 7 is separated from the third outlet expansion chamber 8 by a chamber wall or panel 11. Four second chamber pipes 15 penetrate the chamber panel 11 extending into the intermediate chamber 7 and the outlet chamber 8. A smaller or larger number of pipes could be used. In the preferred example embodiment, the second chamber pipes 15 are shorter than the first chamber pipe 13. The lengths of the second chamber pipes 15 are preferably one quarter of the length of the intermediate chamber 7. The reduced sectional area of the second chamber pipes 15 in the intermediate chamber 7 compresses the volume of the exhaust gas flowing in that intermediate chamber.

The outlet chamber 8 receives the compressed exhaust gas from the second chamber pipes 15 where the exhaust gas expands a third time when entering the outlet chamber 8. The outlet pipe 4 of the muffler body allows the exhaust gas to leave the muffler. The outlet pipe 4 may connect to an upstream end of a tail pipe (not shown) for subsequent exhaust from the vehicle.

The side inlet pipe 2 contributes to the higher sound attenuation. The reason for this higher sound attenuation is explained using the following example. Assume a sound wave propagates from a smaller tube with a cross sectional area $S_1$ into a larger tube with a cross sectional area $S_2$. Because of the cross sectional area expansion, a mismatched acoustic impedance develops at the interface. As a result, the propagating sound wave is reflected back to the source when it reaches the interface between the tubes.

The transmission loss when the sound wave passes through the interface is directly proportional to the expansion ratio. The side inlet pipe design achieves a large expansion ratio, but at a cost—higher flow energy loss and higher back pressure. The flared design of the side inlet pipe and the arrangement of the perforated region in the first chamber pipe 13 offset this higher flow energy loss and higher back pressure.

Figure 7A:
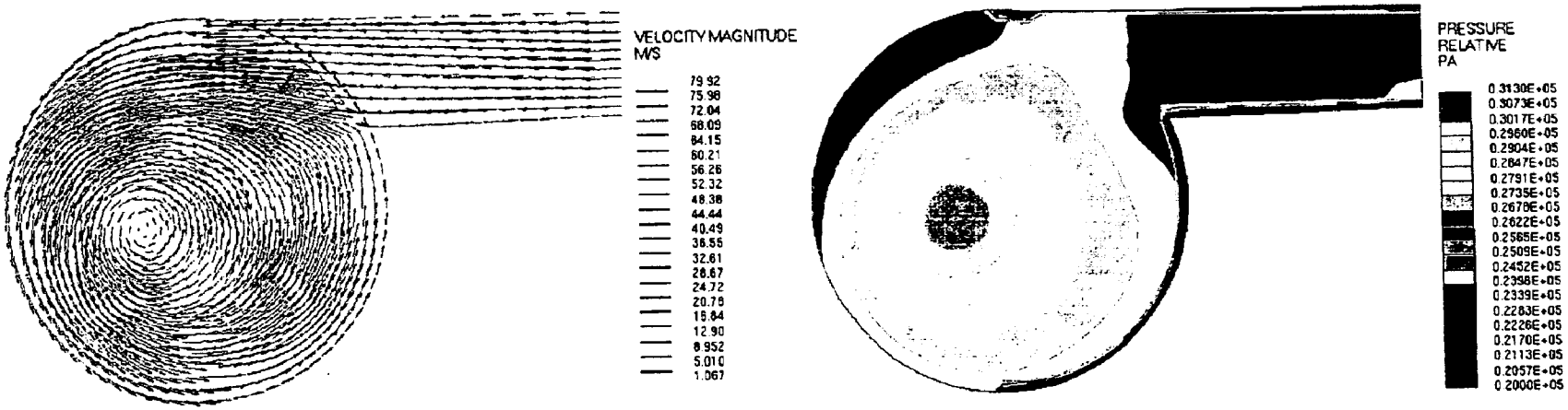
FIGS. 7A–7C illustrate example performance test results of different embodiments of the muffler.
Figure 7B:
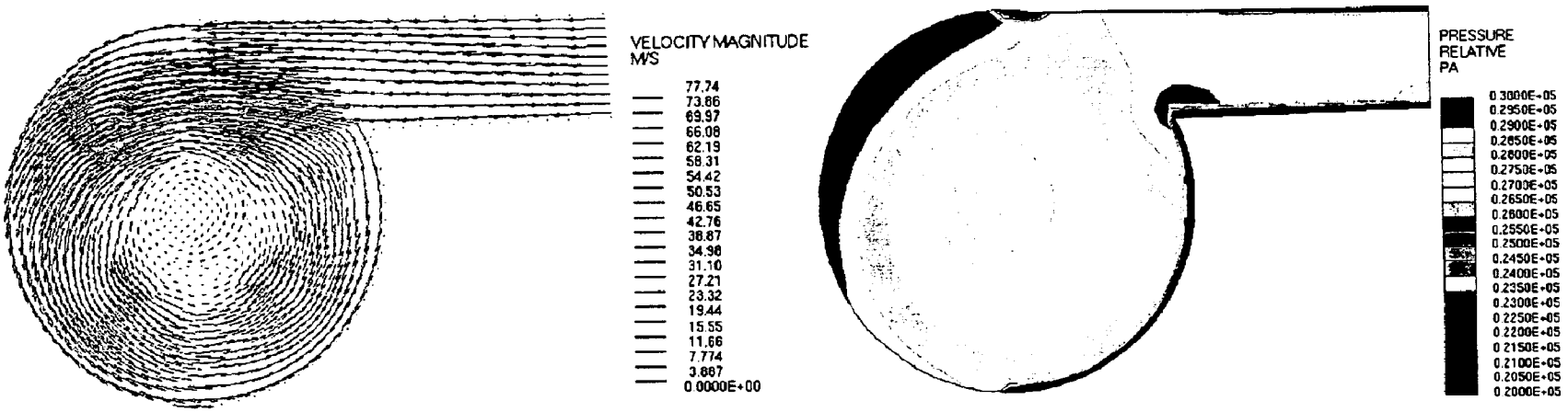
Figure 7C:
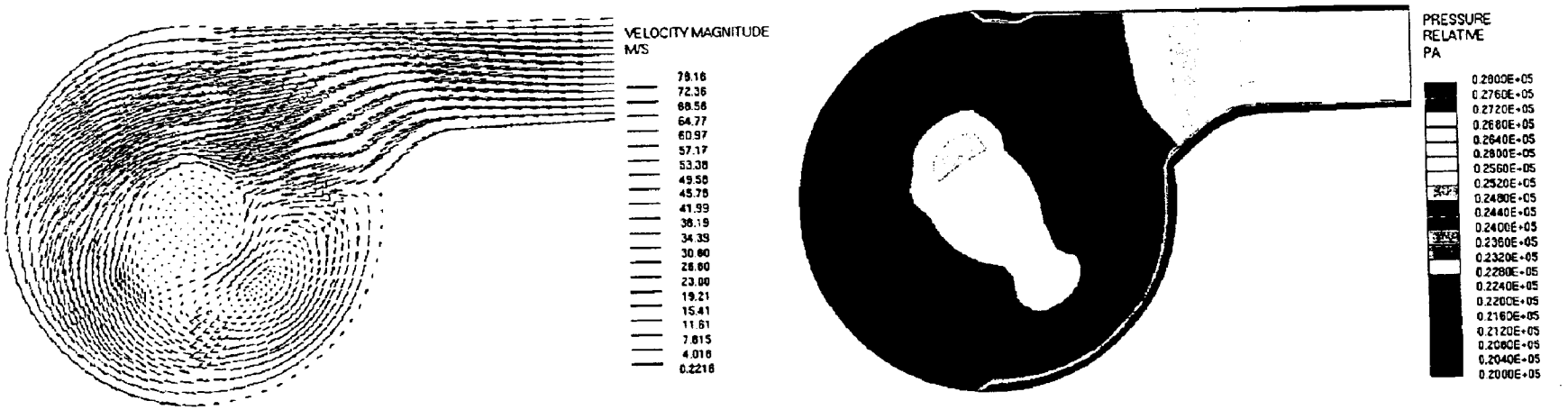

These effects were confirmed using numerical analysis on the muffler design flow characteristics. The velocity and pressure fields for an example flow speed of 75 m/s are shown in FIGS. 7A–7C and demonstrate the effectiveness of the muffler design in various example embodiments. The velocity fields in all three figures plainly show the spiral flow path. FIG. 7A shows the muffler with a side inlet pipe but without a flared opening or perforated region. The resulting back pressure is 0.3 bar. FIG. 7B shows the muffler with a side inlet pipe with the perforated region but without a flared opening. The resulting back pressure is decreased to 0.28 bar. FIG. 7C shows the muffler with a side inlet pipe, a flared opening and the perforated region. The resulting back pressure is reduced even further to 0.25 bar. Note the consistently lighter shading in the side inlet pipe compared to that in FIGS. 7A and 7B.

Although the invention has been described in conjunction with specific embodiments thereof, it is evident that many alternatives, modifications and variations will be apparent to those skilled in the art. It is therefore to be understood that one or more additional chamber(s), pipe(s), and/or perforated pipe portions(s) may be used to achieve enhanced silencing. Accordingly, the invention is intended to embrace all such alternatives, modifications, and variations that fall within the spirit and scope of the appended claims.

What is claimed is:

1. A muffler for use in attenuating a sound induced by or associated with discharging gas produced by a machine, comprising:

an body having a first axis along its length and including a first partition for defining an inlet chamber, the body having an inlet opening on a side and an outlet opening at one end;

an inlet pipe connected at one end to the inlet opening for delivering the gas into the inlet chamber at an angle to the first axis greater than zero degrees;

a first pipe extending from the inlet chamber through the first partition into a second chamber, the first pipe including one or more perforations at a first portion of the first pipe in the inlet chamber, wherein the one or more perforations permit gas in the inlet chamber to flow into the first pipe and into the second chamber;

a second partition defining the second chamber as an intermediate chamber and separating the intermediate chamber from an outlet chamber that includes the outlet opening, wherein a length of the intermediate chamber is about one half a length of the inlet chamber; and an outlet pipe connected to the outlet opening for discharging muffled gas from the body.

2. The muffler in claim 1, wherein the one end of the inlet pipe connecting to the body is flared.

3. The muffler in claim 1, wherein a cross-section of the inlet pipe is square or rectangular.

4. The muffler in claim 1, wherein a cross-section of the inlet pipe is circular or elliptical.

5. The muffler in claim 1, wherein the muffler body is cylindrically-shaped.

6. The muffler in claim 1, wherein a cross-section of the muffler body is elliptical.

7. The muffler in claim 1, wherein the muffler is a reactive muffler.

8. The muffler in claim 1, wherein the inlet pipe is connected to the inlet opening at an angle substantially greater than zero degrees so that gas delivered by the inlet pipe moves in a spiral type path in the inlet chamber.

9. The muffler in claim 8, wherein the inlet pipe is connected to the inlet opening at an angle of 90 degrees.

10. The muffler in claim 1, wherein a length of a portion of the first pipe that extends into the intermediate chamber is on the order of about one half the length of the intermediate chamber.

11. The muffler in claim 1, further comprising:

one or more second pipes extending from the intermediate chamber through the second partition into the outlet chamber.

12. The muffler in claim 11, wherein a length of the intermediate chamber is about one half a length of the inlet chamber and a length of the outlet chamber is less that the length of the intermediate chamber and is based on the length of the inlet chamber.

13. The muffler in claim 11, wherein a length of a portion of one or more of second pipes inside the intermediate chamber is about one quarter of the length of the intermediate chamber.

14. The muffler in claim 12, wherein a number of second pipes is four.

15. The muffler in claim 12, wherein a length of the one or more second pipes is less than a length of the first pipe.

16. The muffler in claim 1, wherein the inlet pipe being coupled to the side of the body is configured to attenuate the sound of the gas without increasing back pressure associated with that sound attenuation in a direction opposite to that of the gas flowing in the inlet pipe.

17. An exhaust muffler for use in attenuating a sound associated with exhaust gas produced by an internal combustion engine, comprising:

an elongated body having a first axis along its length and including a first partition for defining an inlet chamber, the body having an inlet opening on a side and an outlet opening at one end;

a side inlet pipe connected at one end to the inlet opening for delivering the exhaust gas into the inlet chamber from the side of the body;

a first pipe extending from the inlet chamber through the first partition into a second chamber, the first pipe including a peforated first portion in the inlet chamber, wherein the perforated portion permits exhaust gas in the inlet chamber to flow into the first pipe and into the second chamber;

a second partition defining the second chamber as an intermediate chamber and separating the intermediate chamber from an outlet chamber that includes the outlet opening, wherein a length of the intermediate chamber is about one half a length of the inlet chamber; and an outlet pipe connected to the outlet opening for discharging muffled exhaust gas from the body.

18. The muffler in claim 17, wherein the one end of the inlet pipe is flared.

19. The muffler in claim 17, wherein a cross-section of the inlet pipe is square or rectangular.

20. The muffler in claim 17, wherein a cross-section of the inlet pipe is circular or elliptical.

21. The muffler in claim 17, wherein the muffler body is cylindrically-shaped.

22. The muffler in claim 17, wherein a cross-section of the muffler body is elliptical.

23. The muffler in claim 17, wherein the muffler is a reactive muffler.

24. The muffler in claim 17, wherein the inlet pipe is connected to the inlet opening at an angle to the first axis greater than zero degrees so that exhaust gas delivered by the side inlet pipe moves in a spiral type path in the inlet chamber.

25. The muffler in claim 24, wherein the inlet pipe is connected to the inlet opening at an angle of at or near 90 degrees.

26. The muffler in claim 17, wherein a length of a portion of the first pipe that extends into the intermediate chamber is on the order of about one half the length of the intermediate chamber.

27. The muffler in claim 17, further comprising:

one or more second pipes extending from the intermediate chamber through the second partition into the outlet chamber.

28. The muffler in claim 27, wherein a length of the intermediate chamber is about one half a length of the inlet chamber and a length of the outlet chamber is less that the length of the intermediate chamber and is based on the length of the inlet chamber.

29. The muffler in claim 28, wherein a length of a portion of one or more of second pipes inside the intermediate chamber is about one quarter of the length of the intermediate chamber.

30. The muffler in claim 27, wherein a number of second pipes is four.

31. The muffler in claim 27, wherein a length of the one or more second pipes is less than a length of the first pipe.

32. The muffler in claim 27, wherein the inlet pipe being coupled to the side of the body is configured to attenuate the sound of the exhaust gas without increasing back pressure associated with that sound attenuation to the internal combustion engine.

* * * * *